US005827135A

United States Patent [19]

Shimosaka et al.

[11] Patent Number: 5,827,135

[45] Date of Patent: Oct. 27, 1998

[54] GOLF BALL

[75] Inventors: Hirotaka Shimosaka; Keisuke Ihara; Michio Inoue; Atuki Kasasima, all of Chichibu, Japan

[73] Assignee: Bridgestone Sports Co., Ltd., Tokyo, Japan

[21] Appl. No.: 667,470

[22] Filed: Jun. 21, 1996

[30] Foreign Application Priority Data

Jun. 23, 1995 [JP] Japan ..... 7-180977

[51] Int. Cl.[6] ..... A63B 37/14

[52] U.S. Cl. ..... 473/379; 473/382; 473/384

[58] Field of Search ..... 473/383, 384, 473/378, 379, 382

[56] References Cited

U.S. PATENT DOCUMENTS 4,653,758 3/1987 Solheim ..... 473/383 X 5,190,294 3/1993 Oka ..... 473/383

*Primary Examiner*—George J. Marlo

*Attorney, Agent, or Firm*—Sughrue, Mion, Zinn, Macpeak & Seas, PLLC

[57] ABSTRACT

In a golf ball having a multiplicity of dimples of the same type arranged thereon and an equator, 6–12 dimples are arranged along the equator at an equal spacing and centered at the equator. The remaining dimples are arranged such that a great circle which does not intersect the dimples does not exist. A space where a dimple of the same size as the dimples can be formed is not left between the dimples. Due to a uniform arrangement of dimples including equator-centered ones, the golf ball is symmetrical enough to provide an increased carry and consistent flight independent of impact points.

10 Claims, 10 Drawing Sheets

GOLF BALL

BACKGROUND OF THE INVENTION

1. Field of the Invention

This invention relates to a golf ball having a uniform arrangement of dimples and providing consistent flight independent of impact points. It also relates to a mold for use in the preparation of such a golf ball.

2. Prior Art

It is desired that golf balls have a uniform arrangement of dimples on their spherical surface and provide consistent flight independent of impact points.

For the arrangement of dimples on golf balls, there are known various arrangement patterns such as icosahedral and dodecahedral arrangement patterns. Since the mold for molding golf balls typically consists of two mold halves which are mated at a parting line, most golf balls have at least one great circle which corresponds to the parting line of the mold and which does not intersect the dimples at all.

Golf balls having a non-dimple-crossing great circle still inevitably experience a change of flight depending on an impact point even when the dimple arrangement is made as uniform as possible by drawing six great circles thereon.

Japanese Patent Application Kokai (JP-A) Nos. 173907/1986 and 47379/1987 disclose a mold consisting of two mold halves wherein the parting line is corrugated so as to pass by those dimples lying on a normal straight parting line. Using this mold, a golf ball free of a great circle which does not intersect dimples can be molded. The design and fabrication of this mold including a dimple arrangement are very difficult and have not been used in practice.

SUMMARY OF THE INVENTION

An object of the invention is to provide a golf ball which has a multiplicity of dimples uniformly arranged on its spherical surface, is free of a great circle which does not intersect the dimples, and offers consistent flight independent of impact points. Another object of the invention is to provide a mold for use in the preparation of such a golf ball.

According to the invention, there is provided a golf ball having a multiplicity of dimples of the same type arranged thereon and an equator. A plurality of dimples are arranged along the equator and centered at the equator. The remaining dimples are arranged such that a great circle which does not intersect the dimples at all may not be depicted on the surface and a space where a dimple of the same size as the dimples can be formed is not be left between the dimples.

In another aspect, the invention provides a mold for molding a golf ball comprising two equally divided mold halves which are mated at a parting plane in a separable manner to define a spherical cavity therebetween. The parting edge of one mold half is provided with a plurality of bosses each having a dimple-forming protrusion of the same shape on the inner surface. The parting edge of the other mold half is provided with depressions engageable with the bosses. The cavity surfaces of both the mold halves are provided with dimple-forming protrusions of the same shape as the protrusions of the bosses such that a great circle which does not intersect the protrusions at all may not be depicted on the surface and a space where a protrusion of the same shape as the protrusions can be formed is not left between the protrusions.

Since the golf ball of the invention is free of a great circle which does not intersect dimples and has a uniform arrangement of dimples, the ball is symmetrical enough to ensure improved aerodynamics and an increased carry as compared with conventional golf balls. Since the dimple design of the invention does not interfere with a conventional dimple arrangement pattern such as an icosahedral pattern, the golf ball of the invention experiences no change of flight with impact points and maintains directional stability on flight.

The mold of the invention is effective for molding such a golf ball. Although the parting edge of the mold halves is partially protruded or depressed, the bosses and depressions can be easily formed as by screwing and machining, respectively, in contrast to the corrugation of the parting edge staggered around dimples in the prior art seamless ball-forming mold. The design and fabrication of the mold are easy and the formation of protrusions corresponding equator-centered dimples is easy.

BRIEF DESCRIPTION OF THE DRAWINGS

These and further features of the present invention will be apparent with reference to the following description and drawings, wherein.

DETAILED DESCRIPTION OF THE INVENTION

Figure 1:
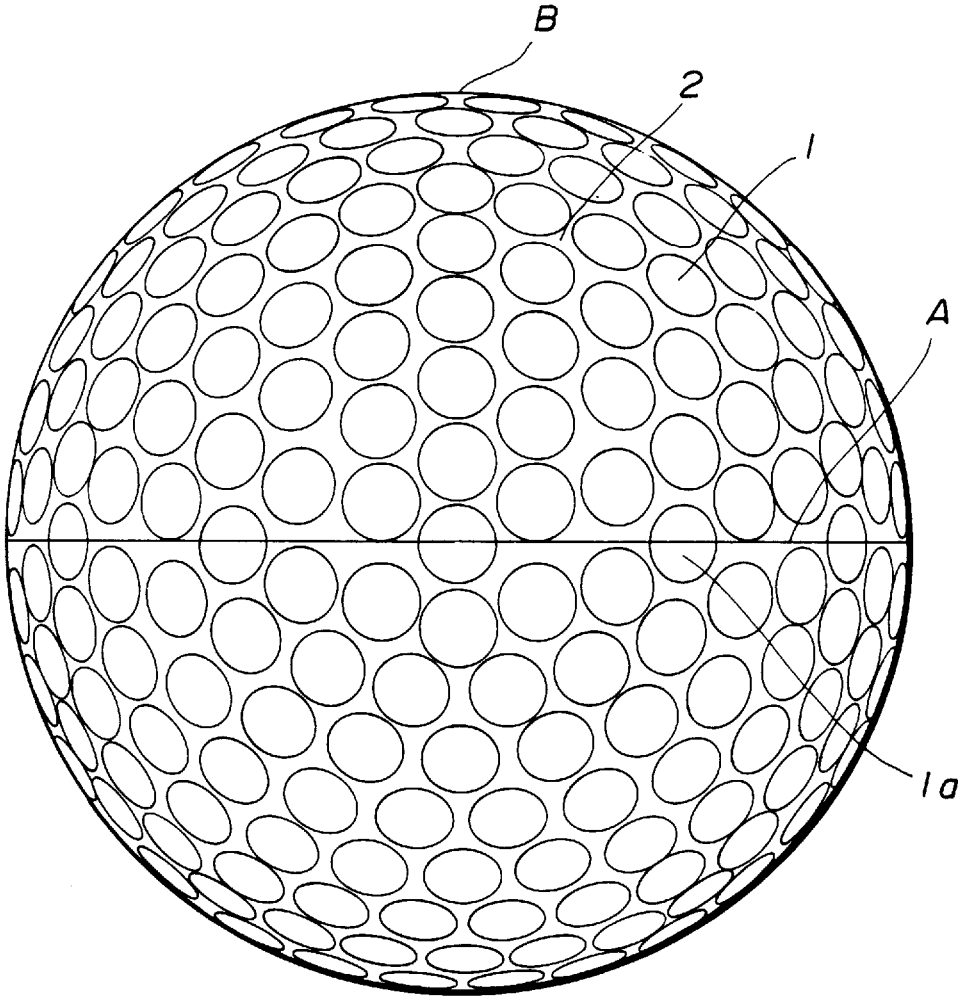
FIGS. 1 and 2 are elevational and plan views of a golf ball according to one embodiment of the invention.
Figure 2:
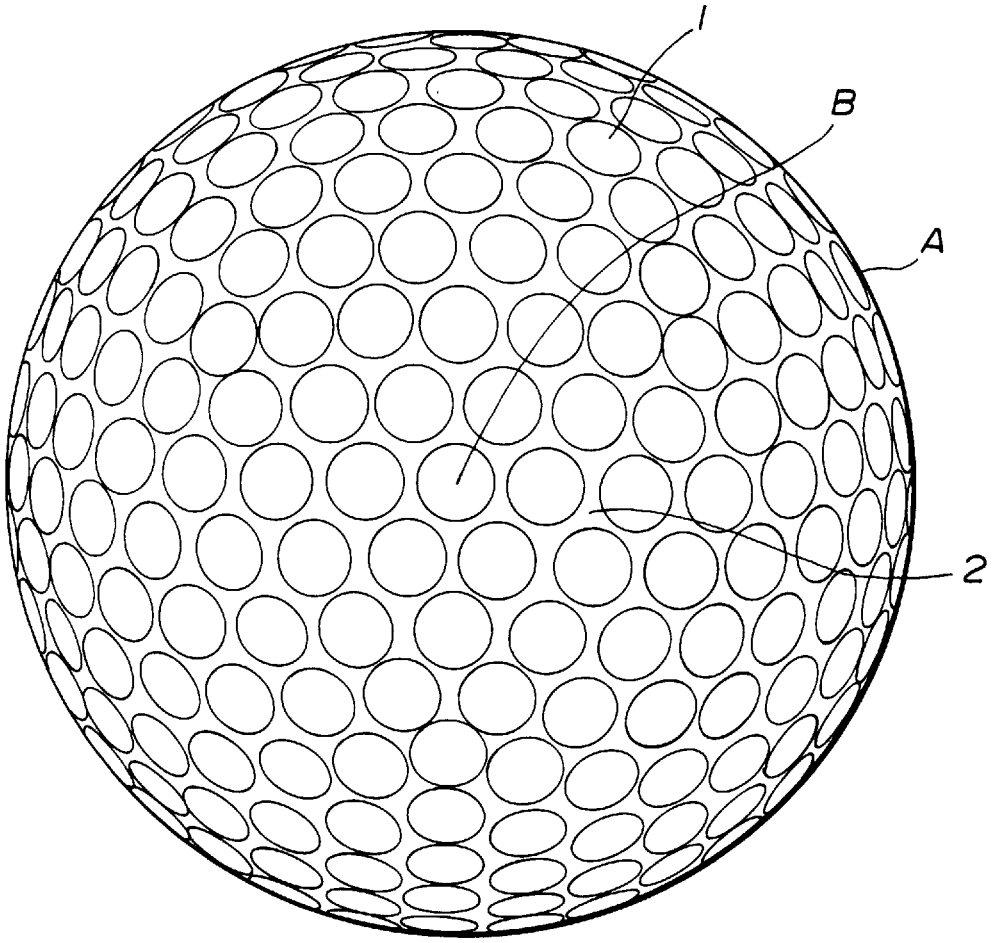
Figure 3:
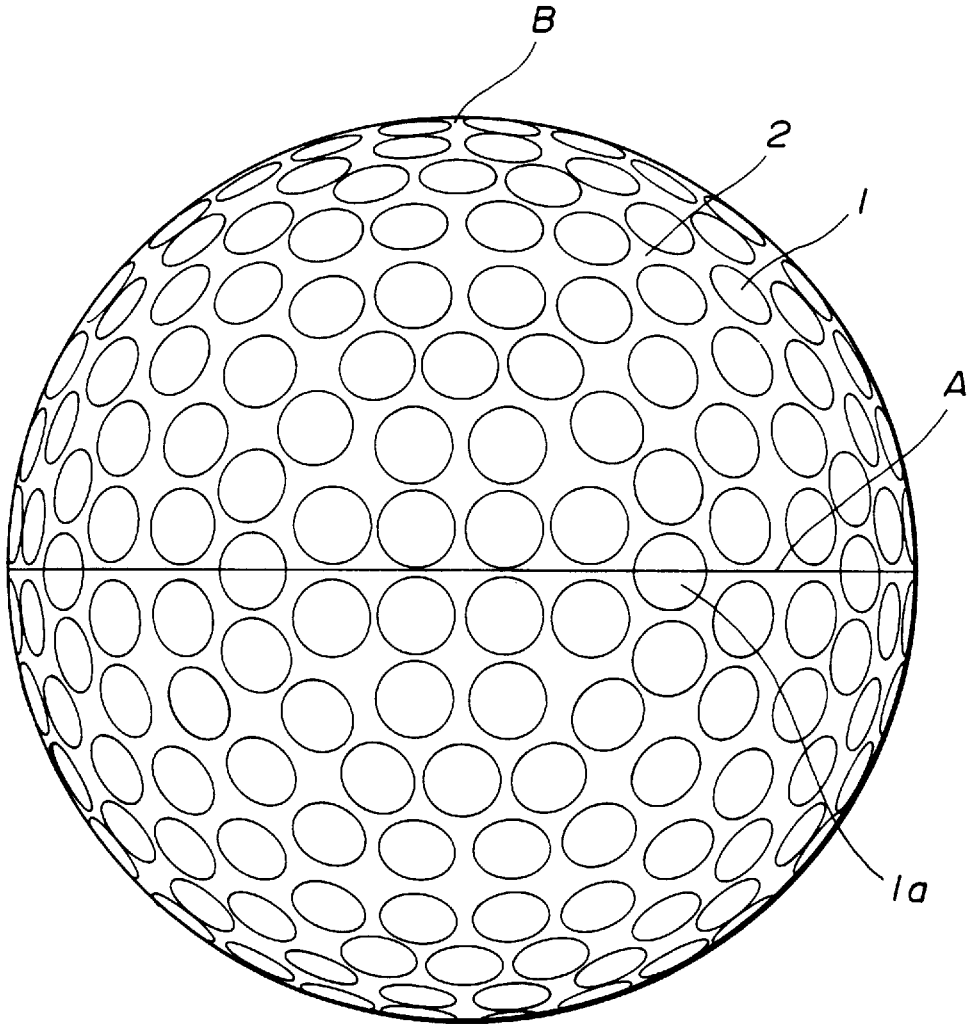
FIG. 3 is an elevational view of a golf ball according to another embodiment of the invention.

Referring to FIGS. 1 and 2, there is illustrated a golf ball according to one embodiment of the invention. FIG. 1 is an elevational view and FIG. 2 is a plan view. FIG. 3 illustrates a golf ball according to another embodiment of the invention. Throughout these figures, A designates an equator line and B designates a pole.

The golf ball of the invention has a multiplicity of dimples 1 of the same type arranged on its spherical surface as shown in the figures. Among the dimples, a plurality of dimples 1*a* are arranged along the equator A and centered at the equator A. The dimples la arranged along the equator A and centered at the equator A are preferably arranged so that they are equally spaced apart from each other. Quite unexpectedly, the arrangement of the dimples 1*a* in this manner eliminates changes of ball flight with impact points as will be later demonstrated in Experiment. The ball flight substantially changes with impact points if there is no dimple or only one dimple which is aligned with the equator A. In this case, if the number of dimples aligned with the equator A is too large or too small, the ball flight may change with impact points. From that point of view, the number of dimples aligned with the equator A is preferably 4 to 18, more preferably 6 to 12.

The remaining dimples 1 other than the dimples 1*a* centered at the equator are arranged such that a great circle which does not intersect the dimples at all does not exist. Also a space where a dimple of the same size as the dimples 1 can be formed is not be left on a land 2 between the dimples 1. The flight would change with impact points if dimples are arranged such that a non-dimple-crossing great circle may be projected on the surface or a dimple-accommodating space may be left on the land 2.

In the practice of the invention, the number of dimples is preferably 300 to 450, especially 360 to 400. For example, the golf ball of FIGS. 1 and 2 has 362 dimples and the golf ball of FIG. 3 has 312 dimples arranged thereon.

The dimple arrangement patterns which can be used herein include orthogonal, icosahedral, and one-side tri-symmetrical (3-fold-rotational symmetry) arrangements. The dimple arrangement pattern of the golf ball shown in FIGS. 1 and 2 is a minor modification of the icosahedral pattern, and the golf ball of FIG. 3 has an octagonal pattern.

Preferably the dimples are circular in planar shape and have a diameter of 3.5 to 3.9 mm and a depth of 0.14 to 0.20 mm.

The golf ball of the invention wherein dimples are uniformly arranged such that a great circle which does not intersect the dimples has improved aerodynamics and travels an increased distance while its flight performance is consistent independent of impact points on the ball.

It is understood that the golf balls of the invention may be solid golf balls such as one-, two- and multiple(three or more)- piece golf balls or thread-wound golf balls.

Figure 4:
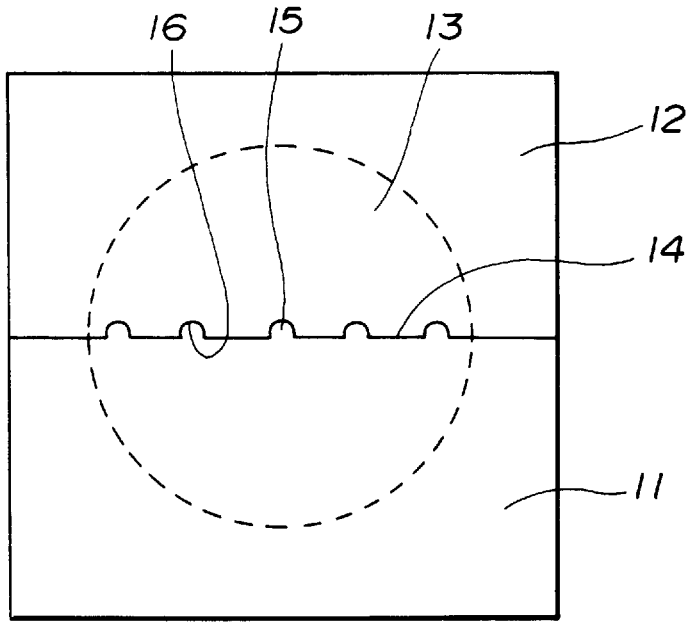
FIG. 4 is a schematic elevational view of a mold according to one embodiment of the invention.

FIG. 4 shows one exemplary mold for the manufacture of the golf ball according to the invention. The mold includes equally divided upper and lower mold halves 11 and 12 which are mated together at a parting plane 14 in a separable manner to define a spherical cavity 13 therebetween. The cavity surface is formed with a multiplicity of dimple-forming protrusions of the same shape such that a great circle does not intersect the protrusions at all and a space where a protrusion of the same shape as the protrusions can be formed may not be left between the protrusions.

At the parting plane 14 between the upper and lower mold halves 11 and 12, the parting edge of the lower mold half 11 on the inner surface is provided with a plurality of bosses 15 having a dimple-forming protrusion of the same shape as the above-mentioned protrusions on the cavity surface. At the same time, the parting edge of the upper mold half 12 is provided with depressions 16 which engage with the bosses 15 on the lower mold half 11.

When a golf ball is molded using the mold defined above, the golf ball will have an equator line A at a position corresponding to the parting plane 14. On equator A, a plurality of dimples la are formed in accordance with the dimple-forming protrusions formed on the inner surface of the bosses 15. In this way, a golf ball as shown in FIGS. 1 to 3 is molded.

The bosses are preferably provided so that they are equally spaced apart from each other. The number of bosses is preferably 4 to 18, more preferably 6 to 12 from the same reason as explained above in connection with the dimples la aligned with the equator A.

Fabrication of the mold is relatively easy since the bosses 15 and depressions 16 may be formed by screwing and machining, respectively, the upper and lower mold halves 11 and 12 are divided at a position substantially corresponding to the equator of a golf ball and provided with a plurality of bosses and depressions engageable therewith, respectively. Also all the bosses (and depressions) are of the same shape.

The manufacture of golf balls using the mold of the invention can be done by conventional techniques including injection molding and compression molding.

The golf ball and mold according to the invention are not limited to the illustrated embodiments and modifications and variations may be made thereon without departing from the scope of the invention. For example, it is acceptable that the upper mold half is provided with bosses and the lower mold half is provided with depressions engageable therewith.

Experiment

There were prepared golf balls having a dimple arrangement as shown in FIGS. 1 to 3 (invention) and FIGS. 5 to 9 (comparison) and dimple parameters as reported in Table 1. Using a swing robot, the ball was tested to measure a carry and a total distance by repeating pole hitting (as shown by an arrow in FIG. 10A) and seam hitting (as shown by an arrow in FIG. 10B) at a head speed of 42 m/sec. From the carry and total distance, a degree of symmetry was determined to evaluate flight performance. The results are shown in Table 1.

TABLE 1

Figure 5:
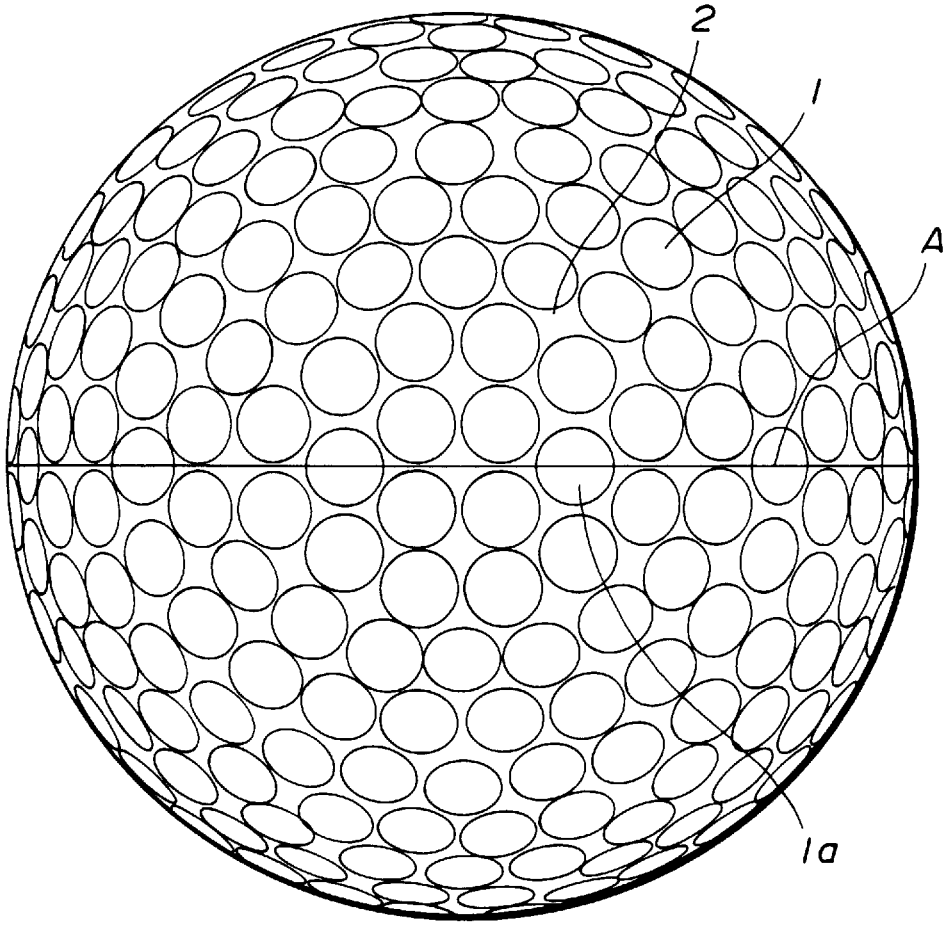
FIGS. 5 and 6 are elevational and plan views of a golf ball of Comparative Example 1.
Figure 6:
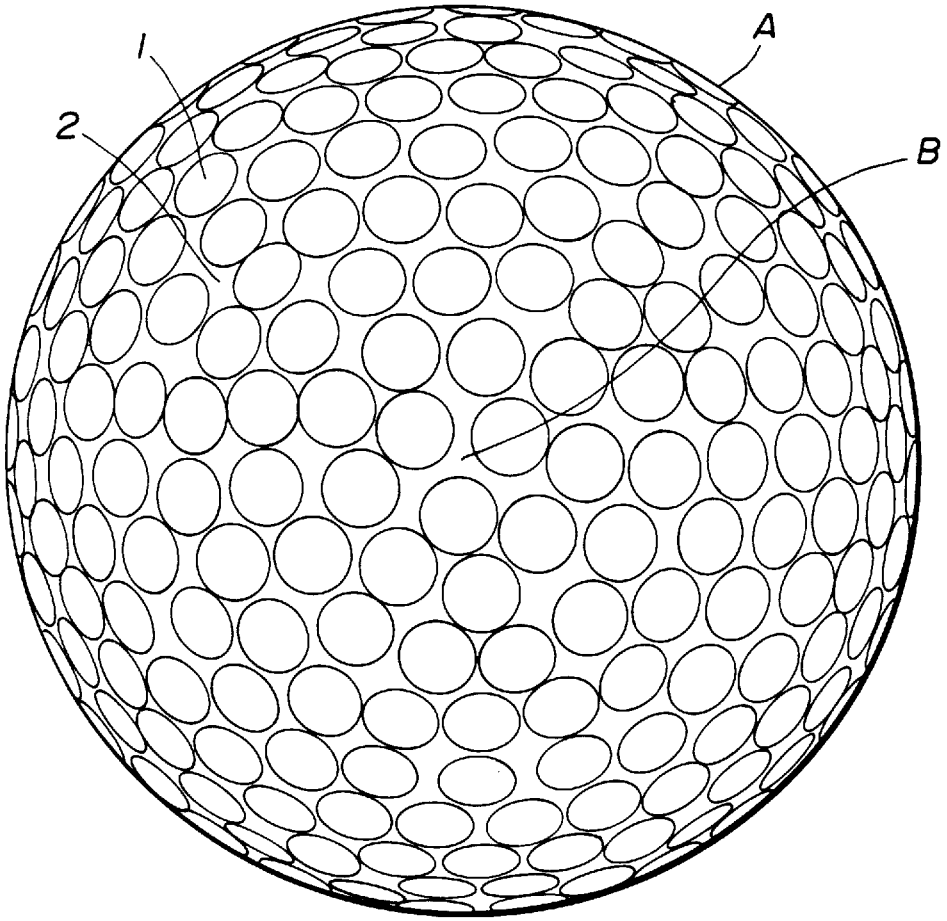
Figure 7:
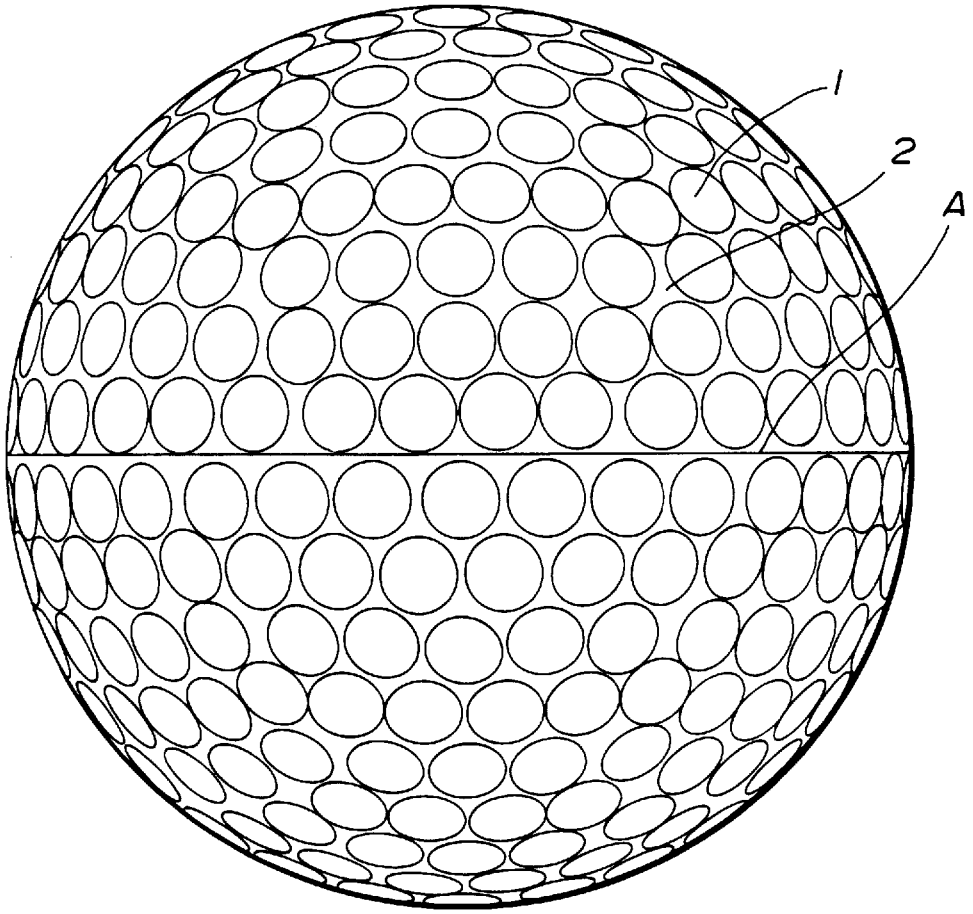
FIGS. 7 and 8 are elevational and plan views of a golf ball of Comparative Example 2.
Figure 8:
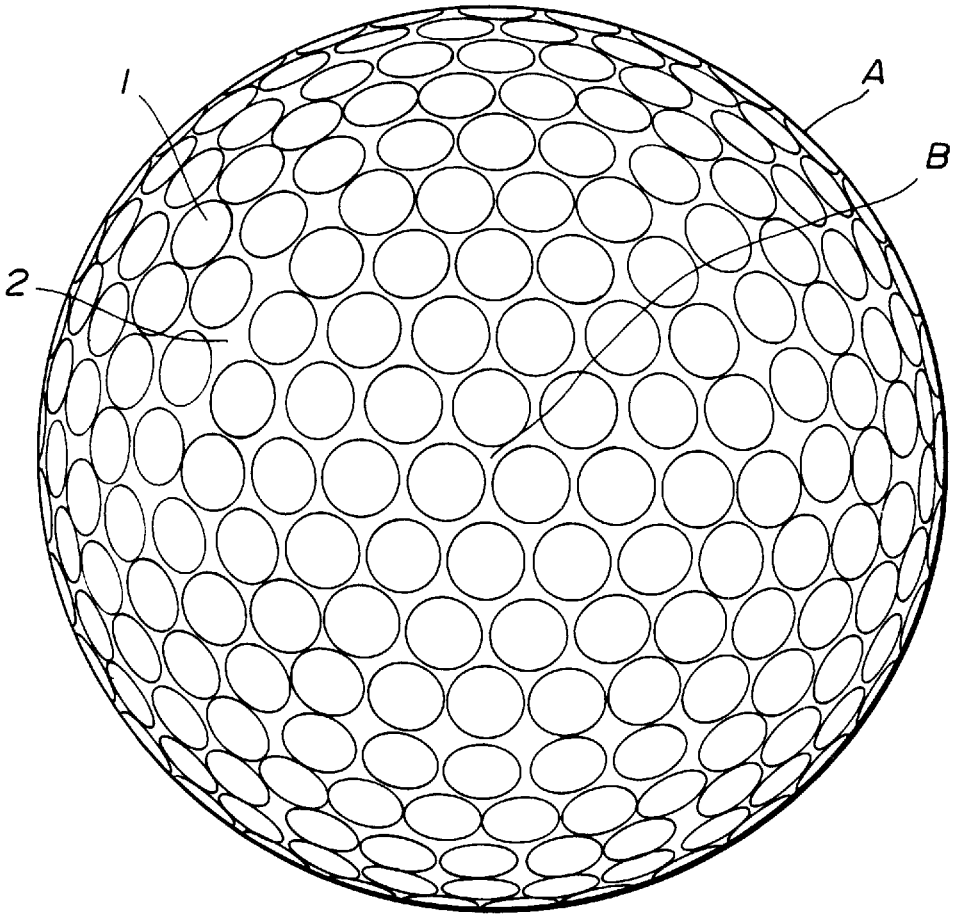
Figure 9:
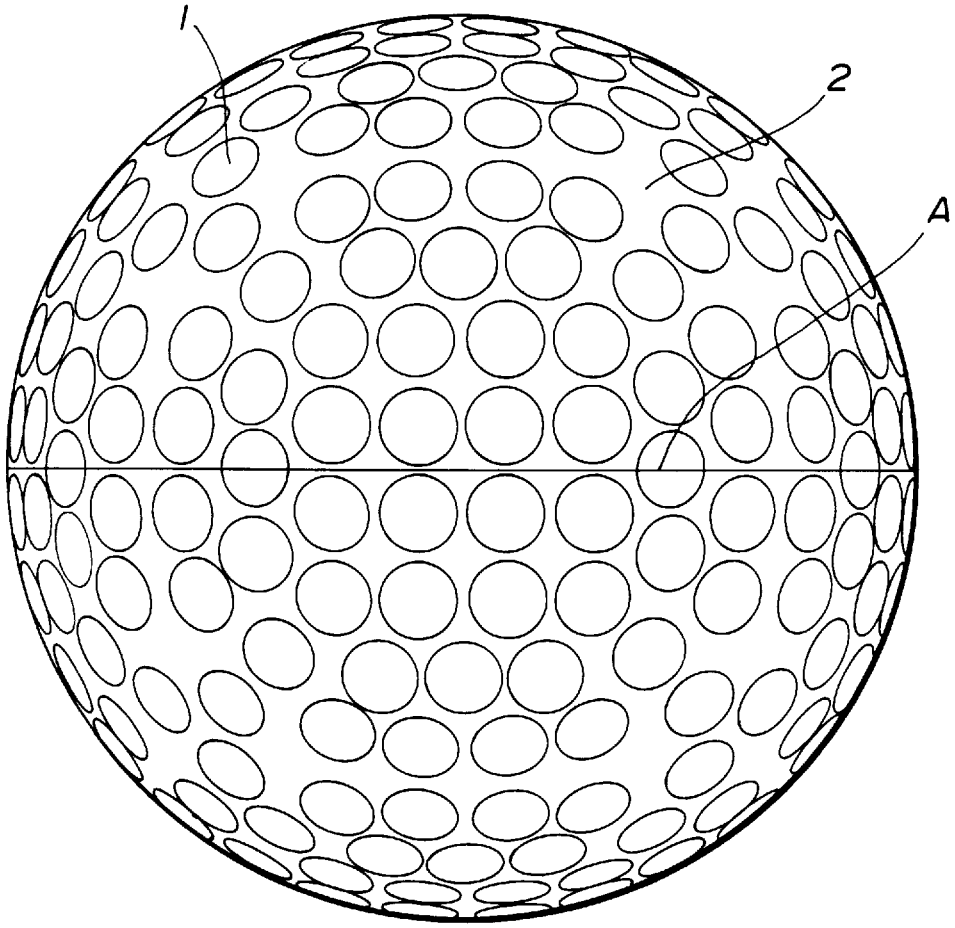
FIG. 9 is an elevational view of a golf ball of Comparative Example 3.
Figure 10A:
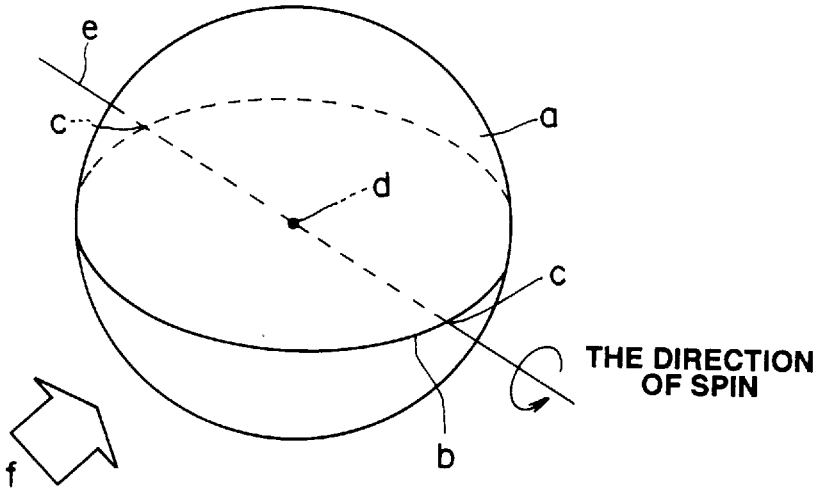
FIG. 10 illustrates the direction in which a golf ball is shot in a test, FIG. 10A showing pole hitting and FIG. 10B showing seam hitting.
Figure 10B:
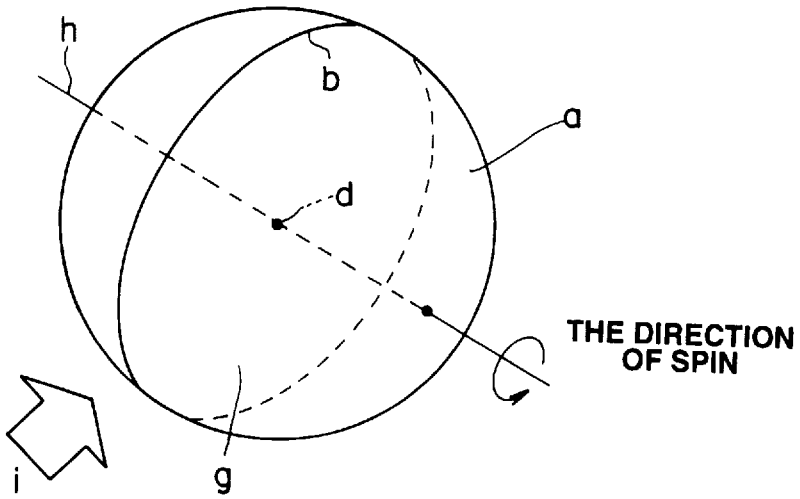

| | | Example | | Comparative Example | | |
|---|---|---|---|---|---|---|
| | | 1 FIG. 1, 2 | 2 FIG. 3 | 1 FIG. 5, 6 | 2 FIG. 7, 8 | 3 FIG. 9 |
| Number of dimples | | 362 | 312 | 400 | 396 | 312 |
| Number of dimple types | | 1 | 1 | 3 | 1 | 1 |
| Dimple diameter (mm) | max | 3.800 | 3.700 | 3.800 | 3.660 | 3.700 |
| | min | — | — | 3.300 | — | |
| Dimple depth (mm) | max | 0.142 | 0.200 | 0.156 | 0.152 | 0.200 |
| | min | — | — | 0.128 | — | — |
| Dimple volume ratio* | | 0.84 | 0.86 | 0.79 | 0.83 | 0.86 |
| Placement of dimple on land | | No | No | No | No | Yes |
| Number of dimples on equator | | 12 | 8 | 12 | 0 | 8 |
| Carry | | | | | | |
| Seam hitting (m) | | 196.7 | 195.3 | 195.5 | 195.0 | 193.3 |
| Pole hitting (m) | | 196.1 | 195.8 | 192.5 | 193.2 | 192.9 |
| Average (m) | | 196.4 | 195.6 | 194.0 | 194.1 | 193.1 |
| Difference (m) | | 0.6 | −0.5 | 3.0 | 1.8 | 0.4 |
| Total distance | | | | | | |
| Seam hitting (m) | | 211.4 | 209.3 | 209.8 | 208.8 | 207.4 |
| Pole hitting (m) | | 210.9 | 210.1 | 207.5 | 206.5 | 206.9 |

TABLE 1-continued

| | Example | | Comparative Example | | |
|---|---|---|---|---|---|
| | 1 FIG. 1, 2 | 2 FIG. 3 | 1 FIG. 5, 6 | 2 FIG. 7, 8 | 3 FIG. 9 |
| Average (m) | 211.2 | 209.7 | 208.7 | 207.7 | 207.2 |
| Difference (m) | 0.5 | −0.8 | 2.3 | 2.3 | 0.5 |

*Dimple volume ratio = (dimple volume)/(ball volume) × 100%

Due to a uniform arrangement of dimples of the same type including a plurality of dimples aligned with the equator and the elimination of a great circle which does not intersect the dimples, the golf ball of the invention is symmetrical enough to provide an increased carry and consistent flight independent of impact points. The mold of the invention ensures effective molding of golf balls of the above-mentioned attributes and is itself easy to fabricate.

Although some preferred embodiments have been described, many modifications and variations may be made thereto in the light of the above teachings. It is therefore to be understood that within the scope of the appended claims, the invention may be practiced otherwise than as specifically described.

We claim:

1. A golf ball having a multiplicity of dimples of the same size arranged thereon and an equator, wherein 6 to 12 dimples are arranged along the equator and centered at the equator, and the remaining dimples are arranged such that a great circle does not intersect the dimples at all does not exist and a space where a dimple of the same size as said dimples can be formed is not left between the dimples.

2. The golf ball of claim 1 wherein said dimples are equally spaced apart from each other.

3. The golf ball of claim 1 wherein the total number of dimples is in the range of 300 to 450.

4. The golf ball of claim 1 wherein the total number of dimples is in the range of 360 to 400.

5. The golf ball of claim 1 wherein the total number of dimples is 312.

6. The golf ball of claim 1 wherein the total number of dimples is 362.

7. The golf ball of claim 1 wherein said dimples are arranged in substantially an icosahedral pattern.

8. The golf ball of claim 1 wherein said dimples are arranged in an octagonal pattern.

9. The golf ball of claim 1 wherein said dimples are circular having a diameter in the range of 3.5 to 3.9 mm.

10. The golf ball of claim 1 wherein said dimples are circular and have a depth of 0.14 to 0.20 mm.

* * * * *